United States Patent [19]

Camenzind et al.

[11] Patent Number: 4,734,210

[45] Date of Patent: Mar. 29, 1988

[54] ADDITIVES FOR LUBRICANT COMPOSITIONS

[75] Inventors: Hugo Camenzind, Fribourg; Paul Dubs, Marly, both of Switzerland

[73] Assignee: Ciba-Geigy Corporation, Ardsley, N.Y.

[21] Appl. No.: 888,910

[22] Filed: Jul. 22, 1986

[30] Foreign Application Priority Data

Jul. 30, 1985 [CH] Switzerland ..... 3291/85

[51] Int. Cl.[4] ..... C10M 133/00

[52] U.S. Cl. ..... 252/47.5

[58] Field of Search ..... 252/47.5

[56] References Cited

U.S. PATENT DOCUMENTS

| | | | |
|---|---|---|---|
| 3,634,457 | 1/1972 | Doyle, Jr. | 71/67 |
| 3,809,651 | 5/1974 | Crawford et al. | 252/47.5 |
| 4,198,304 | 4/1986 | Inoue et al. | 252/47.5 |
| 4,225,450 | 9/1980 | Rosenberger | 252/47.5 |
| 4,358,597 | 11/1982 | Fields | 252/47.5 |

FOREIGN PATENT DOCUMENTS 1569730 6/1980 United Kingdom .

OTHER PUBLICATIONS

H. S. Gandhi et al, Applied Catalysis 3, 79 (1982).

*Primary Examiner*—William R. Dixon, Jr.
*Assistant Examiner*—Cynthia A. Prezlock
*Attorney, Agent, or Firm*—Luther A. R. Hall

[57] ABSTRACT

The invention relates to lubricant compositions comprising at least one compound of the general formula I

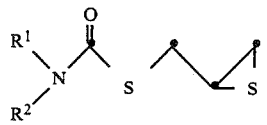

(I)

wherein $R^1$ and $R^2$ are independently alkyl, alkenyl, cycloalkyl, aryl or aralkyl; or $R^1$ and $R^2$ together with the nitrogen atom to which they are attached form a heterocyclic ring.

The N,N-disubstituted S-thiiranylmethylcarbamothioates of formula I are particularly suitable for use as antiwear additives and extreme pressure additives for mineral and synthetic lubricants.

8 Claims, No Drawings

ADDITIVES FOR LUBRICANT COMPOSITIONS

The present invention relates to the use of N,N-disubstituted S-thiiranylmethylcarbamothioates as additives for lubricants and to lubricant compositions containing these compounds.

It is customary to treat mineral and synthetic lubricants with additives to improve their performance properties. Particularly useful additives are those that protect the machine which it is desired to lubricate from wear. It is required of these additives that they shall increase the load-carrying capacity of the lubricant, that they shall not have a corrosive action on the metal parts to be protected, and that they shall have good heat resistance.

For this utility it is preferred to use phosphorus- and sulfur-containing compounds such as, for example, salt of dialkyldithiophosphates according to German Offenlegungsschrift No. 2 921 620. In view of the use of catalysts in exhaust gas systems of combustion engines, however, the phosphorus content of lubricating oils shall be kept to a minimum to prevent the catalysts from becoming deactivated [H. S. Gandhi et al., Applied Catalysis 3, (1982), 79–82].

N,N-Disubstituted S-thiiranylmethylcarbamothioates and the use thereof as herbicides are disclosed e.g. in U.S. Pat. No. 3,634,457. However, a utility of these compounds as additives for lubricants has not yet been described.

It has now been found that N,N-disubstituted S-thiiranylmethylcarbamothioates have excellent properties in mineral and synthetic lubricants with regard to affording protection from wear, to load-carrying capacity and to freedom from ash content.

Accordingly, the present invention relates to compositions comprising a lubricant and at least one compound of formula I

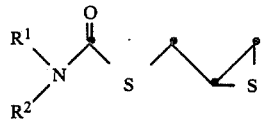

(I)

wherein $R^1$ and $R^2$ are each independently selected from $C_1$–$C_{24}$alkyl, $C_1$–$C_{24}$alkyl which is interrupted by one or more identical or different members selected from —O—, —S— and/or

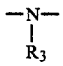

and/or which contains one or more oxo and/or thiono groups; or $C_3$–$C_{24}$alkenyl, $C_2$–$C_4$hydroxyalkyl, $C_5$–$C_8$-cycloalkyl, phenyl or phenyl which is substituted by one or two $C_1$–$C_{12}$alkyl, $C_1$–$C_4$alkoxy, $C_2$–$C_{24}$alkoxycarbonyl and/or nitro groups; or naphthyl, $C_7$–$C_{10}$aralkyl, furan-2-ylmethyl or tetrahydrofuran-2-ylmethyl, or $R^1$ and $R^2$, together with the nitrogen atom to which they are attached, form a 5- or 6-membered mononuclear aliphatic heterocyclic ring which, in addition to the N atom, may contain one or two additional N, O and/or S atoms as ring members and/or one or two oxo and/or thiono groups as substituents, or form an indolinyl, 1,2,3,4-tetrahydroquinolinyl or 1,2,3,4-tetrahydroisoquinolinyl radical which radicals are unsubstituted or substituted by 1 to 3 methyl groups, and $R^3$ is hydrogen or $C_1$–$C_8$alkyl.

$R^1$ and $R^2$ as $C_1$–$C_{24}$alkyl are straight chain or branched substituents, for example methyl, ethyl, n-propyl, isopropyl, n-butyl, sec-butyl or tert-butyl, 1,3-dimethylbutyl, 2-ethylbutyl, n-pentyl, isopentyl, 1-methylpentyl, n-hexyl, 2-ethylhexyl, n-heptyl, isoheptyl, 1-methylheptyl, n-octyl, straight chain or branched nonyl, decyl, undecyl, dodecyl, tridecyl, tetradecyl, pentadecyl, hexadecyl, octadecyl or eicosyl. Preferably $R^1$ and $R^2$ as alkyl are $C_1$–$C_{20}$alkyl, in particular $C_1$–$C_{12}$alkyl and, most preferably, $C_1$–$C_8$alkyl.

Alkyl substituents $R^1$ and $R^2$ which are interrupted by —O—,

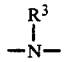

and/or —S— and/or are substituted by oxo and/or thiono groups contain preferably 2 to 18, in particular 3 to 12 and, most preferably, 3 to 7, carbon atoms. Such substituents are in particular alkoxyalkyl, alkoxyalkoxy, polyalkoxyalkyl, preferably polyethoxyalkyl, alkylthioalkyl, alkylaminoalkyl and dialkylaminoalkyl radicals. The oxo and/or thiono groups may also be located e.g. at a carbon atom adjacent to an —O—, —N— or —S— chain member to form alkyl chains, which are interrupted e.g. by ester, amide or thioester functions. Typical examples of such radicals are those of the formula —alkylene—COO—alkyl,

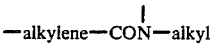

and —alkylene—C(S)O—alkyl. The chain length of alkylene+alkyl is as described above for the total alkyl radical. Examples of alkyl radicals containing hetero atoms are those which, as indicated above, contain ester or amide functions, preferably however alkoxyalkyl (e.g. of 3 to 7 carbon atoms), alkoxyalkoxyalkyl and polyethoxyalkyl, e.g. polyethoxyethyl.

Representative examples of an alkyl radical $R^3$ are: methyl, ethyl, n-propyl, isopropyl, n-butyl, sec-butyl or tert-butyl, 1,3-dimethylbutyl, 2-ethylbutyl, n-pentyl, isopentyl, 1-methylpentyl, n-hexyl, 2-ethylhexyl, n-heptyl, isoheptyl, 1-methylheptyl, and n-octyl. $R^3$ is preferably hydrogen or $C_1$–$C_4$alkyl.

$R^1$ and $R^2$ as $C_2$–$C_4$hydroxyalkyl may be e.g. 2-hydroxyethyl, 2-hydroxypropyl, 3-hydroxypropyl, 2-hydroxybutyl or 4-hydroxybutyl, with 2-hydroxyethyl being preferred.

$R^1$ and $R^2$ as $C_3$–$C_{24}$alkenyl are e.g. allyl, butenyl, pentenyl, hexenyl, octenyl, decenyl, dodecenyl or oleyl. Preferably $R^1$ and $R^2$ are $C_3$–$C_{18}$alkenyl, in particular $C_3$–$C_7$alkenyl and, most preferably, allyl.

$R^1$ and $R^2$ as $C_5$–$C_8$cycloalkyl may be e.g. cyclopentyl, cyclohexyl, 4-methylcyclohexyl or cyclooctyl. $R^1$ and $R^2$ are preferably a $C_5$–$C_6$cycloalkyl radical and, most preferably, a cyclohexyl radical.

$R^1$ and $R^2$ as phenyl substituted by one or two $C_1$–$C_{12}$alkyl or $C_1$–$C_4$alkoxy, $C_2$–$C_{24}$alkoxycarbonyl and/or nitro groups may be e.g. 2-, 3- or 4-tolyl, xylyl, 4-isopropylphenyl, 4-tert-butylphenyl, 3-methoxyphenyl or 4-propoxyphenyl, 3-carbethoxyphenyl or 3-nitrophenyl. Preferably such a phenyl radical is substituted by only one type of substituent. An alkoxycarbonyl substituent contains preferably 2 to 18, in particular 2 to 12 and, most preferably, 2 to 5, carbon atoms. Preferred substituted phenyl radicals are those substituted by one or two $C_1$–$C_4$alkyl radicals.

$R^1$ and $R^2$ as a $C_7$–$C_{10}$aralkyl radical may be e.g. benzyl, α-methylbenzyl, α,α-dimethylbenzyl, 1-phenylethyl, 2-phenylethyl, 2-phenylpropyl, 3-phenylpropyl or 3-(4-tolyl)propyl, with benzyl being the preferred meaning.

A 5- or 6-membered aliphatic heterocyclic ring —$NR^1R^2$ preferably does not contain a further hetero atom or contains an additional N or O atom as ring member and/or one or two oxo groups. Preferred ring are the pyrrolidine, oxazolidine, piperidine, imidazolidine, morpholine, piperazine, 4-methylpiperazine or 4-ethylpiperazine radical, with the pyrrolidine, piperidine or morpholine ring being most preferred.

—$NR^1R^2$ as an indoline, 1,2,3,4-tetrahydroisoquinoline or 1,2,3,4-tetrahydroquinoline ring which is unsubstituted or substituted by 1, 2 or 3 methyl groups is preferably an unsubstituted 1,2,3,4-tetrahydroquinolinyl radical or a 2,2,4-trimethyl-1,2,3,4-tetrahydroquinolinyl radical.

Lubricant compositions meriting particular mention are those which contain at least one compound of formula I, wherein $R^1$ and $R^2$ are each independently selected from $C_1$–$C_{20}$alkyl, $C_3$–$C_7$alkenyl, $C_2$–$C_4$hydroxyalkyl, $C_3$–$C_{12}$alkoxyalkyl, $C_5$–$C_8$cycloalkyl, phenyl or phenyl which is substituted by one or two $C_1$–$C_{12}$alkyl or $C_1$–$C_4$alkoxy groups; or naphthyl, $C_7$–$C_9$aralkyl, furan-2-ylmethyl or tetrahydrofuran-2-ylmethyl, or —$NR^1R^2$ is a 5- or 6-membered aliphatic heterocyclic ring or an indolinyl, 1,2,3,4-tetrahydroquinolinyl or 1,2,3,4-tetrahydroisoquinolinyl radical.

A subgroup of novel compositions comprises those which contain, in addition to a lubricant, at least one compound of formula I, wherein $R^1$ and $R^2$ are each independently selected from $C_1$–$C_{24}$alkyl, $C_1$–$C_{24}$alkyl which is interrupted by one or more identical or different members selected from the group consisting of —O—, —S— and/or

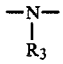

and/or which contains one or more oxo and/or thiono groups; or $C_3$–$C_{24}$alkenyl, $C_5$–$C_8$cycloalkyl, phenyl or phenyl which is substituted by one or two $C_1$–$C_{12}$alkyl, $C_1$–$C_4$alkoxy, $C_2$–$C_{24}$alkoxycarbonyl and/or nitro groups; or naphthyl, $C_7$–$C_9$aralkyl, furan-2-ylmethyl or tetrahydrofuran-2-ylmethyl, and $R^3$ is hydrogen or $C_1$–$C_8$alkyl.

A further subgroup of novel compositions comprises those which contain, in addition to a lubricant, at least one compound of formula I, wherein —$NR^1R^2$ is a 5- or 6-membered mononuclear aliphatic heterocyclic ring or an indolinyl, 1,2,3,4-tetrahydroquinolinyl or 1,2,3,4-tetrahydroisoquinolinyl radical.

Preferred compositions are those comprising a lubricant and at least one compound of formula I, wherein $R^1$ and $R^2$ are each independently selected from $C_1$–$C_{12}$alkyl, $C_5$–$C_6$cycloalkyl, phenyl or phenyl which is substituted by one or two $C_1$–$C_4$alkyl groups; or benzyl, allyl, 2-methoxyethyl or 2-methoxypropyl, or —$NR^1R^2$ is a pyrrolidinyl, piperidinyl, morpholinyl, indolinyl, piperazinyl, 4-methylpiperazin-1-yl, 1,2,3,4-tetrahydroquinolinyl or 1,2,3,4-tetrahydroisoquinolinyl radical.

Particularly preferred compositions are those comprising a lubricant and at least one compound of formula I, wherein $R^1$ and $R^2$ are each independently selected from $C_1$–$C_8$alkyl, cyclohexyl, phenyl or benzyl, or —$NR^1R^2$ is a pyrrolidinyl, piperidinyl, morpholinyl or 1,2,3,4-tetrahydroquinolinyl radical.

Most preferably, the novel compositions comprise a lubricant and at least one compound of formula I, wherein $R^1$ is phenyl or benzyl and $R^2$ is $C_1$–$C_4$alkyl or benzyl, or —$NR^1R^2$ forms a piperidine or morpholine ring.

Representative examples of compounds of formula I which may be present in the lubricant compositions of this invention are:

S-thiiranylmethyl-N,N-dihexylcarbamothioate
S-thiiranylmethyl-N,N-bis(1-methylethyl)carbamothioate
S-thiiranylmethyl-N,N-bis(3-methylbutyl)carbamothioate
S-thiiranylmethyl-N,N-bis(2-propenyl)carbamothioate
S-thiiranylmethyl-N-cyclopentyl-N-methylcarbamothioate
S-thiiranylmethyl-N-cyclohexyl-N-methylcarbamothioate
S-thiiranylmethyl-N-methyl-N-(tetrahydrofuran-2-ylmethyl)carbamothioate
S-thiiranylmethyl-N-methyl-N-octylcarbamothioate
S-thiiranylmethyl-N,N-bis(2-methoxyethyl)carbamothioate
S-thiiranylmethyl-N-methyl-N-(4-tolyl)carbamothioate
S-thiiranylmethyl-N-methyl-N-benzylcarbamothioate
S-thiiranylmethyl-N-piperidinylcarbamothioate
S-thiiranylmethyl-(4-methylpiperazinyl)carbamothioate.

The compounds of formula I are known and can be prepared for example as described in U.S. Pat. No. 3,634,457 either by reacting dithiocarbamates of formula

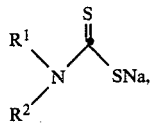

wherein $R^1$ and $R^2$ are as defined, with epichlorohydrin, or by reacting secondary amines of formula

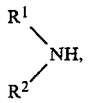

wherein $R^1$ and $R^2$ are as defined, with carbon disulfide and epichlorohydrin.

The N,N-disubstituted S-thiiranylmethylcarbamothioates constitute lubricant additives which are distinguished by very good extreme pressure and, in particular, antiwear properties. Moreover, they do not have a corrosive effect on the metal parts to be lubricated. The compounds of formula I are effective even when incorporated in lubricants in very minor amounts. Thus mineral and synthetic lubricant oils and mixtures thereof which contain 0.05 to 5% by weight, preferably 0.05 to 3% by weight, based on the lubricant, of a compound of formula I have excellent properties, in particular antiwear properties. The suitable lubricants are known to the skilled person and are described e.g. in "Schmierstoffe und verwandte Produkte" (Verlag Chemie, Weinheim, 1982).

The additives of this invention are heat resistant in mineral and synthetic lubricants. They have no ash content and contain no phosphorus. This latter feature is especially important in view of the use of lubricants in combustion engines fitted with catalysts in the exhaust gas system, as these catalysts age more rapidly as a consequence of phosphorus residues.

Hence the invention also relates to the use of compounds of formula I according to claim 1 as additives for mineral and synthetic lubricants.

The lubricant compositions of this invention may contain other additives which are incorporated to enhance the basic properties of lubricants still further. These further basic additives comprise: antioxidants, metal deactivators, rust inhibitors, viscosity index improvers, pour-point depressors, dispersants, surfactants and other extreme pressure additives and antiwear additives.

EXAMPLES OF PHENOLIC ANTIOXIDANTS

1. Alkylated monophenols 2,6-di-tert-butyl-4-methylphenol
2,6-di-tert-butylphenol
2-tert-butyl-4,6-dimethylphenol
2,6-di-tert-butyl-4-ethylphenol
2,6-di-tert-butyl-4-n-butylphenol
2,6-di-tert-butyl-4-sec-butylphenol
2,6-dicyclopentyl-4-methylphenol
2-(α-methylcyclohexyl)-4,6-dimethylphenol
2,6-di-octadecyl-4-methylphenol
2,4,6-tricyclohexylphenol
2,6-di-tert-butyl-4-methoxymethylphenol
o-tert-butylphenol

2. Alkylated hydroquinones 2,6-di-tert-butyl-4-methoxyphenol
2,5-di-tert-butyl-hydroquinone
2,5-di-tert-amyl-hydroquinone
2,6-diphenyl-4-octadecyloxyphenol

3. Hydroxylated thiodiphenyl ethers 2,2'-thio-bis(6-tert-butyl-4-methylphenol)
2,2'-thio-bis(4-octylphenol)
4,4'-thio-bis(6-tert-butyl-3-methylphenol)
4,4'-thio-bis(6-tert-butyl-2-methylphenol)

4. Alkylidene bisphenols 2,2'-methylene-bis(6-tert-butyl-4-methylphenol)
2,2'-methylene-bis(6-tert-butyl-4-ethylphenol)
2,2'-methylene-bis[4-methyl-6-(α-methylcyclohexyl)-phenol]
2,2'-methylene-bis(4-methyl-6-cyclohexylphenol)
2,2'-methylene-bis(6-nonyl-4-methylphenol)
2,2'-methylene-bis(4,6-di-tert-butylphenol)
2,2'-ethylidene-bis(4,6-di-tert-butylphenol)
2,2'-ethylidene-bis(6-tert-butyl-4-isobutylphenol)
2,2'-methylene-bis[6-(α-methylbenzyl)-4-nonylphenol]
2,2'-methylene-bis[6-(α,α-dimethylbenzyl)-4-nonylphenol]
4,4'-methylene-bis-(2,6-di-tert-butylphenol)
4,4'-methylene-bis(6-tert-butyl-2-methylphenol)
1,1-bis-(5-tert-butyl-4-hydroxy-2-methylphenyl)-butane
2,6-di-(3-tert-butyl-5-methyl-2-hydroxybenzyl)-4-methylphenol
1,1,3-tris-(5'-tert-butyl-4'-hydroxy-2'-methylphenyl)-3-n-dodecylmercaptobutane
ethylene glycol bis[3,3-bis-(3'-tert-butyl-4'-hydroxyphenyl)-butyrate]
di-(3-tert-butyl-4-hydroxy-5-methylphenyl)-dicyclopentadiene
di-[2-(3'-tert-butyl-2'-hydroxy-5'-methylbenzyl)-6-tert-butyl-4-methylphenyl]terephthalate.

5. Benzyl compounds 1,3,5-tris(3,5-di-tert-butyl-4-hydroxybenzyl)-2,4,6-trimethylbenzene
bis(3,5-di-tert-butyl-4-hydroxybenzyl)sulfide
isooctyl 3,5-di-tert-butyl-4-hydroxybenzylmercaptoacetate
bis(4-tert-butyl-3-hydroxy-2,6-dimethylbenzyl)dithiolterephthalate
1,3,5-tris(3,5-di-tert-butyl-4-hydroxybenzyl)isocyanurate
1,3,5-tris(4-tert-butyl-3-hydroxy-2,6-dimethylbenzyl-)isocyanurate
dioctadecyl 3,5-di-tert-butyl-4-hydroxybenzylphosphonate
calcium salt of monoethyl 3,5-di-tert-butyl-4-hydroxybenzylphosphonate.

6. Acylaminophenols 4-hydroxylauric anilide
4-hydroxystearic anilide
2,4-bisoctylmercapto-6-(3',5'-tert-butyl-4'-hydroxyanilino)-s-triazine
octyl N-(3,5-di-tert-butyl-4-hydroxyphenyl)carbamate

7. Esters of β-(3,5-di-tert-butyl-4-hydroxyphenyl)propionic acid with monohydric or polyhydric alcohols, for example with methanol, octadecanol, 1,6-hexanediol, neopentyl glycol, thiodiethylene glycol, diethyleneglycol, triethylene glycol, pentaerythritol, trishydroxyethyl isocyanurate, dihydroxyethyloxalyldiamide.

8. Esters of β-(5-tert-butyl-4-hydroxy-3-methylphenyl)propionic acid with monohydric or polyhydric alcohols, for example methanol, octadecanol, 1,6-hexanediol, neopentylglycol, thiodiethyleneglycol, diethylene glycol, triethyleneglycol, pentaerythritol, trishydroxyethyl isocyanurate or dihydroxyethyl oxalyldiamide.

9. Amides of β-(3,5-di-tert-butyl-4-hydroxyphenyl)propionic acid, for example
N,N'-bis(3,5-di-tert-butyl-4-hydroxyphenylpropionyl)-hexamethylenediamine
N,N'-bis(3,5-di-tert-butyl-4-hydroxyphenylpropionyl)-trimethylenediamine
N,N'-bis(3,5-di-tert-butyl-4-hydroxyphenylpropionyl)-hydrazine.

EXAMPLES OF AMINE ANTIOXIDANTS

N,N'-diisopropyl-p-phenylenediamine
N,N'-di-sec-butyl-p-phenylenediamine
N,N'-bis(1,4-dimethylpentyl)-p-phenylenediamine
N,N'-bis(1-ethyl-3-methylpentyl)-p-phenylenediamine
N,N'-bis(1-methylheptyl)-p-phenylenediamine N,N'-diphenyl-p-phenylenediamine
N,N'-di(naphthyl-2-)-p-phenylenediamine
N-isopropyl-N'-phenyl-p-phenylenediamine
N-(1,3-dimethylbutyl)-N'-phenyl-p-phenylenediamine
N-(1-methylheptyl)-N'-phenyl-p-phenylenediamine
N-cyclohexyl-N'-phenyl-p-phenylenediamine
bis-4-(toluenesulfonamidophenyl)amine
N,N'-dimethyl-N,N'di-sec-butyl-p-phenylenediamine
diphenylamine
4-isopropoxydiphenylamine
N-phenyl-1-naphthylamine
N-phenyl-2-naphthylamine
octylated diphenylamine
4-n-butylaminophenol
4-n-butyrylaminophenol
4-nonanoylaminophenol
4-dodecanoylaminophenol
4-octadecanoylaminophenol
di-(4-methoxyphenyl)amine
2,6-di-tert-butyl-4-dimethylaminomethylphenol
2,4-diaminodiphenylmethane
4,4'-diaminodiphenylmethane
N,N,N'N'-tetramethyl-4,4'-diaminodiphenylmethane
1,2-di(phenylamino)ethane
1,2-di-[(2-methylphenyl)amino]ethane
(o-tolyl)biguanide
di-[4-(1',3'-dimethylbutyl)phenyl]amine
tert-octylated N-phenyl-1-naphthylamine
mixture of mono- and dialkylated tert-butyl- and tert-octyldiphenylamines.

Examples of metal deactivators are:

for copper, e.g.: triazole, benzotriazole and derivatives thereof, 2-mercaptobenzotriazole, 2,5-dimercaptothiadiazole, salicylidene propylenediamine, salts of salicylaminoguanidine.

Examples of rust inhibitors are:

(a) Organic acids, the esters, metal salts and anhydrides thereof, e.g.: N-oleylsarcosine, sorbitan monooleate, lead naphthenate, dodecenylsuccinic anhydride, monoalkenyl succinate, 4-nonylphenoxyacetic acid.

(b) Nitrogen-containing compounds, for example:

I. Primary, secondary or tertiary aliphatic or cycloaliphatic amines and amine salts of organic and inorganic acids, for example oil-soluble alkylammonium carboxylates.

II. Heterocyclic compounds, e.g. substituted imidazolines and oxazolines.

(c) Phosphorous-containing compounds, for example: amine salts of phosphoric acid partial esters.

(d) Sulfur-containing compounds, for example: barium dinonylnaphthalenesulfonates, calcium petroleum sulfonates.

Examples of viscosity index improvers are:

polymethylacrylates, vinyl pyrrolidone/methacrylate copolymers, polybutene, olefin copolymers, styrene/acrylate copolymers.

Examples of pour-point depressors are:

polymethacrylates, alkylated naphthalene derivatives.

Examples of dispersants/surfactants are:

polybutenylsuccinimides, polybutenylphosphonic acid derivatives, basic magnesium, calcium and barium sulfonates and phenolates.

Examples of anti-wear additives are:

compounds which contain sulfur and/or phosphorous and/or halogen, such as sulfurised vegetable oils, zinc dialkyldithiophosphates, tritolylphosphate, chlorinated paraffins, alkyl disulfides and aryl disulfides.

The following Examples illustrate the invention in more detail.

EXAMPLE 1

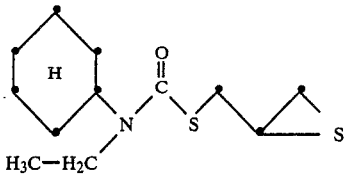

A solution of 8.2 ml (0.1 mole) of epichlorohydrin in 100 ml of toluene is added dropwise to a suspension of 24.3 g (0.1 mole) of sodium N-cyclohexyl-N-ethyldithiocarbamate monohydrate in 200 ml of toluene. After addition of 10 ml of methanol, the clear solution becomes a suspension, the temperature rising from 25° C. to 65° C. The reaction is brought to completion by stirring for 30 minutes at 50° C. The reaction mixture is then thoroughly washed with water and the organic phase is dried over sodium sulfate and concentrated by evaporation under vaccum. 24 g of pale yellow oil of medium viscosity are filtered through 200 g of silica gel using toluene as eluant, affording 11.7 g (45% yield) of S-thiiranylmethyl-N-cyclohexyl-N-ethylcarbamothioate in the form of a colourless oil of medium viscosity.

Analysis (%): theory: C, 55.56; H, 8.16; N, 5.40; S, 24.72. found: C, 55.56; H, 8.09; N, 5.37; S, 24.37.

EXAMPLE 2

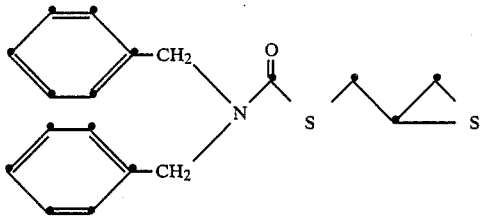

19.8 ml (20.3 g; 0.1 mole) of dibenzylamine are added dropwise at ≦30° C. over 1 hour to a well stirred mixture of 7.8 ml (9.25 g; 0.1 mole) of epichlorohydrin and 6.0 ml (7.6 g; 0.1 mole) of carbon disulfide. The ensuing reaction is strongly exothermic. Stirring is continued for 1.5 hours at 80°–90° C. under a slight vacuum (11–50 torr). The viscous oil so obtained is diluted with 100 ml of toluene and then 14.0 ml (0.1 mole) of triethylamine are added. The dense slurry is diluted with a further 200 ml of toluene and the organic phase is washed with a saturated solution of sodium chloride, dried over sodium sulfate and filtered through a column of 300 g of silica gel and concentrated by evaporation, affording 25.1 g (=74%) of S-thiiranylmethyl-N,N-bis(phenylmethyl)carbamothioate as a clear, pale yellow viscous oil. $n_D^{20}=1.6186$.

Analysis (%): theory: C, 65.62; H, 5.81; N, 4.25; S, 19.46. found: C, 65.54; H, 5.84; N, 4.24; S, 19.62.

EXAMPLES 3–11

Further compounds listed in Table 1 are prepared in accordance with Example 1.

TABLE 1

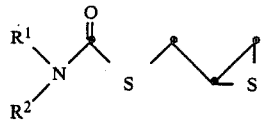

| Example No. | 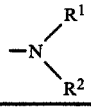 | Yield (%) | Properties | Phys. data | Analysis % (1st line: theory 2nd line: found) C | H | N | S |
|---|---|---|---|---|---|---|---|---|
| 3 |  | 48 | yellow viscous oil | b.p. 104–8° C. (0.1 mm) | 55.13<br>55.38 | 8.87<br>8.88 | 5.36<br>5.35 | 24.53<br>24.11 |
| 4 | 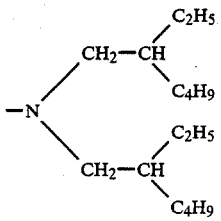 | 80 | pale yellow viscous oil | $n_D^{20}$ = 1.5070 | 64.29<br>64.43 | 10.52<br>10.49 | 3.75<br>3.72 | 17.16<br>17.05 |
| 5 | 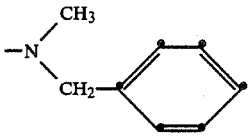 | 43 | clear, colourless viscous oil | $n_D^{20}$ = 1.5998 | 56.88<br>56.95 | 5.97<br>5.94 | 5.53<br>5.58 | 25.31<br>25.32 |
| 6 | 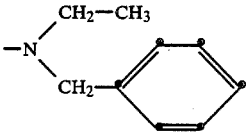 | 54 | clear, colourless viscous oil | $n_D^{20}$ = 1.5890 | 58.39<br>58.53 | 6.41<br>6.41 | 5.24<br>5.29 | 23.98<br>23.88 |
| 7 | 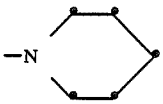 | 37 | yellowish oil | $n_D^{20}$ = 1.5771 | 49.74<br>49.72 | 6.96<br>7.00 | 6.44<br>6.50 | 29.50<br>29.52 |
| 8 | 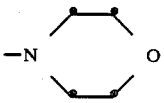 | 45 | white crystalline solid | m.p. 68–70° C. | 43.81<br>43.81 | 5.97<br>6.04 | 6.39<br>6.37 | 29.24<br>29.00 |
| 9 | 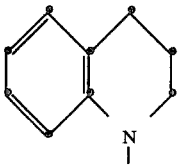 | 53 | clear, pale yellow viscous oil | $n_D^{20}$ = 1.6370 | 58.84<br>58.87 | 5.70<br>5.71 | 5.28<br>5.28 | 24.16<br>24.07 |
| 10 | 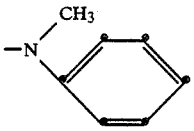 | 62 | white crystalline solid | m.p. 48–50° C. | 55.20<br>55.48 | 5.47<br>5.64 | 5.85<br>5.92 | |
| 11 | 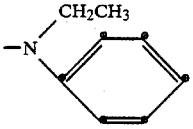 | 58 | white crystalline solid | m.p. 68–70° C. | 56.88<br>57.03 | 5.97<br>6.15 | 5.53<br>5.56 | |

USE EXAMPLES 1-11

The weld load (WL) and the wear scar diameter (WSD) are determined using the Shell four-ball machine (IP 239/73, Extreme Pressure and Wear Lubricant Test for Oils and Greases, Four-Ball Machine) according to the ASTM standard method D 2783-81.

WL = weld load: the load at which the 4 balls become welded together within 10 seconds WSD = wear scar diameter: the average diameter of the scars produced on the 3 immobile balls after 1 hour at a load of 400N.

The base oil employed is Catenex ® P 941 (ex Shell). The test results are reported in Table 2.

TABLE 2

| Additive of Example | Concentration of additive (% by wt.) | W.L. (N) | W.S.D. (mm) |
|---|---|---|---|
| without additive | — | 1 600 | 0.90 |
| 1 | 1.0 | 2 200 | 0.55 |
| | 2.5 | 2 600 | |
| 2 | 1.0 | 2 200 | 0.50 |
| | 2.5 | 2 400 | |
| 3 | 1.0 | 2 200 | 0.55 |
| | 2.5 | 2 600 | |
| 4 | 1.0 | 2 000 | 0.60 |
| | 2.5 | 2 200 | |
| 5 | 1.0 | 2 400 | 0.50 |
| | 2.5 | 2 600 | |
| 6 | 1.0 | 2 200 | 0.55 |
| | 2.5 | 2 600 | |
| 7 | 1.0 | 2 600 | 0.55 |
| | 2.5 | 3 000 | |
| 8 | 1.0 | 2 600 | 0.55 |
| | 2.5 | 3 000 | |
| 9 | 1.0 | 2 200 | 0.50 |
| | 2.5 | 2 600 | |
| 10 | 1.0 | 2 400 | 0.50 |
| | 2.5 | 3 000 | |
| 11 | 1.0 | 2 400 | 0.55 |
| | 2.5 | 3 000 | |

What is claimed is:

1. A lubricant composition which comprises (a) a lubricant, and (b) 0.05 to 5% by weight, based on component (a), of at least one compound of formula I

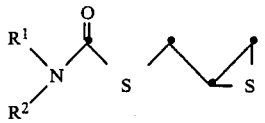

(I)

wherein $R^1$ and $R^2$ are each independently $C_1$–$C_{24}$alkyl, $C_1$–$C_{24}$alkyl which is interrupted by one or more identical or different members selected from —O—, —S— and/or

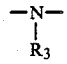

and/or which contains one or more oxo and/or thiono groups; or $C_3$–$C_{24}$alkenyl, $C_2$–$C_4$hydroxyalkyl, $C_5$–$C_8$cycloalkyl, phenyl or phenyl which is substituted by one or two $C_1$–$C_{12}$alkyl, $C_1$–$C_4$alkoxy, $C_2$–$C_{24}$alkoxycarbonyl and/or nitro groups; or naphthyl, $C_7$–$C_{10}$aralkyl, furan-2-ylmethyl or tetrahydrofuran-2-ylmethyl, or $R^1$ and $R^2$, together with the nitrogen atom to which they are attached, form a 5- or 6-membered mononuclear aliphatic heterocyclic ring which, in addition to the N atom, may contain one or two additional N, O and/or S atoms as ring members and/or one or two oxo and/or thiono groups as substituents, or form an indolinyl, 1,2,3,4-tetrahydroquinolinyl or 1,2,3,4-tetrahydroisoquinolinyl radical which radicals are unsubstituted or substituted by 1 to 3 methyl groups, and $R^3$ is hydrogen or $C_1$–$C_8$alkyl.

2. A composition according to claim 1, wherein $R^1$ and $R^2$ are each independently $C_1$–$C_{20}$alkyl, $C_3$–$C_7$alkenyl, $C_2$–$C_4$hydroxyalkyl, $C_3$–$C_{12}$alkoxyalkyl, $C_5$–$C_8$cycloalkyl, phenyl or phenyl which is substituted by one or two $C_1$–$C_{12}$alkyl or $C_1$–$C_4$alkoxy groups; or naphthyl, $C_7$–$C_9$aralkyl, furan-2-ylmethyl or tetrahydrofuran-2-ylmethyl, or —$NR^1R^2$ is a 5- or 6-membered aliphatic heterocyclic ring or an indolinyl, 1,2,3,4-tetrahydroquinolinyl or 1,2,3,4-tetrahydroisoquinolinyl radical.

3. A composition according to claim 1, wherein $R^1$ and $R^2$ are each independently $C_1$–$C_{24}$alkyl, $C_1$–$C_{24}$alkyl which is interrupted by one or more identical or different members selected from the group consisting of —O—, —S— and/or

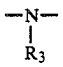

and/or which contains one or more oxo and/or thiono groups; or $C_3$–$C_{24}$alkenyl, $C_5$–$C_8$cycloalkyl, phenyl or phenyl which is substituted by one or two $C_1$–$C_{12}$alkyl, $C_1$–$C_4$alkoxy, $C_2$–$C_{24}$alkoxycarbonyl and/or nitro groups; or naphthyl, $C_7$–$C_9$aralkyl, furan-2-ylmethyl or tetrahydrofuran-2-ylmethyl, and $R^3$ is hydrogen or $C_1$–$C_8$alkyl.

4. A composition according to claim 1, wherein —$NR^1R^2$ is a 5- or 6-membered mononuclear aliphatic heterocyclic ring or an indolinyl, 1,2,3,4-tetrahydroquinolinyl or 1,2,3,4-tetrahydroisoquinolinyl radical.

5. A composition according to claim 1, wherein $R^1$ and $R^2$ are each independently $C_1$–$C_{12}$alkyl, $C_5$–$C_6$cycloalkyl, phenyl or phenyl which is substituted by one or two $C_1$–$C_4$alkyl groups; or benzyl, allyl, 2-methoxyethyl or 2-methoxypropyl, or —$NR^1R^2$ is a pyrrolidinyl, piperidinyl, morpholinyl, indolinyl, piperazinyl, 4methylpiperazin-1-yl, 1,2,3,4-tetrahydroquinolinyl or 1,2,3,4-tetrahydroisoquinolinyl radical.

6. A composition according to claim 1, wherein $R^1$ and $R^2$ are each independently $C_1$–$C_8$alkyl, cyclohexyl, phenyl or benzyl, or —$NR^1R^2$ is a pyrrolidinyl, piperidinyl, morpholinyl or 1,2,3,4-tetrahydroquinolinyl radical.

7. A composition according to claim 1, wherein $R^1$ is phenyl or benzyl and $R^2$ is $C_1$–$C_4$alkyl or benzyl, or —$NR^1R^2$ form a piperidine or morpholine ring.

8. A method of improving the antiwear and extreme pressure properties of a mineral or synthetic lubricant which comprises incorporating into said lubricant 0.05 to 5% by weight, based on the lubricant, of at least one compound of formula I according to claim 1.

* * * * *